US009512850B2

(12) United States Patent
Kunze et al.

(10) Patent No.: US 9,512,850 B2
(45) Date of Patent: Dec. 6, 2016

(54) AIR CIRCULATOR POWERED BY AN ELECTRONICALLY COMMUTED MOTOR (ECM) AND ASSOCIATED METHOD OF USE

(75) Inventors: John C. Kunze, Springfield, MO (US); Jay Matthew Cupps, Cassville, MO (US); Steven W. Post, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 569 days.

(21) Appl. No.: 13/328,805

(22) Filed: Dec. 16, 2011

(65) Prior Publication Data

US 2013/0156609 A1 Jun. 20, 2013

(51) Int. Cl.
*F04B 17/03* (2006.01)
*F04B 49/06* (2006.01)
*F04D 25/06* (2006.01)

(52) U.S. Cl.
CPC ..... *F04D 25/0606* (2013.01)

(58) Field of Classification Search
CPC ..... F04D 25/0606; H02K 23/66; H02K 27/28
USPC ..... 310/62, 68 R, 68 D, 68 A
See application file for complete search history.

(56) References Cited

U.S. PATENT DOCUMENTS 4,648,551 A 3/1987 Thompson et al.
5,006,744 A 4/1991 Archer et al.
5,227,704 A 7/1993 Erdman
5,306,976 A 4/1994 Beckman
5,391,837 A 2/1995 Carey
5,519,273 A 5/1996 Keck
5,592,058 A 1/1997 Archer et al.
6,020,667 A 2/2000 Carey et al.
6,196,803 B1 3/2001 Hill et al.
6,348,752 B1 2/2002 Erdman et al.
6,369,536 B2 4/2002 Beifus et al.
6,408,502 B1 6/2002 Brahmavar et al.
6,423,118 B1 7/2002 Becerra et al.
7,568,885 B2 8/2009 Parker et al.
7,594,798 B1 * 9/2009 Bucher et al. ..... 416/100
2004/0051496 A1 * 3/2004 Archer et al. ..... 318/825
2006/0261690 A1 * 11/2006 Petersen ..... 310/68 B
2010/0247316 A1 * 9/2010 Aynsley et al. ..... 416/189
2011/0204832 A1 8/2011 Zavodny et al.

OTHER PUBLICATIONS

"Access Floor Products LHK, PFC, TAF-R, TAF-HC, TAF-D, and TAF-V", Titus Installation Manual AF-IOM-1.0, Sep. 26, 2005, 6 pages.

(Continued)

*Primary Examiner* — Peter J Bertheaud
*Assistant Examiner* — Dominick L Plakkoottam
(74) *Attorney, Agent, or Firm* — Thompson Coburn LLP

(57) ABSTRACT

An air circulator that includes an electronically commuted motor that is devoid of a transformer and utilizes line voltage as the signal voltage. The motor includes a rotatable blade assembly having at least one blade, wherein the blade assembly is connected to the electronically commuted motor, a housing that is operatively connected to the electronically commuted motor and having a line voltage input, and a switch that is secured to the housing and electrically connected to a signal voltage input of the electronically commuted motor and the line voltage input.

20 Claims, 6 Drawing Sheets

(56) References Cited

OTHER PUBLICATIONS

"ECM motors on whole house fan . . .", HVACquick.com website—http://blog.hvacquick.com/?s=ecm (Blog posted on Jun. 30, 2010), Printed off website on Nov. 7, 2012, pp. 1-2.
"ECMotor Replacement Reward—$150 Reward for ECMotor Replacement—Offer Good Through Feb. 28, 2013", Minnesota Power Website—http://www.mnpower.com/powerofone/one_home/hvac/specials/ECM%20Fan%20Motor%20Replacement%20Rebate/index.htm (Printed from website on Nov. 7, 2012), pp. 1-2.
"Fan Powered Terminals VAV Terminals", Titus Installation Manual FB-IOM-1.0, Jul. 27, 2006, 6 pages.
"Price Underfloor Products Service & Installation Manual", www/price-hvac.com, Jun. 2011, pp. 1-31, Reference No. I-10.
Ehrlich, "A New Spin on Efficient Home Ceiling Fans", Posted on Apr. 4, 2011 on http://greenspec.building green.com./blogs/new-spin-efficient-home-ceiling-fans (Printed from website on Nov. 7, 2011), pp. 1-4.

* cited by examiner

AIR CIRCULATOR POWERED BY AN ELECTRONICALLY COMMUTED MOTOR (ECM) AND ASSOCIATED METHOD OF USE

BACKGROUND OF THE INVENTION

Traditional air circulators, e.g., fans, are powered by permanent-split capacitor motors or three-phase induction motors. These types of motors use greater amounts of energy and are less inefficient then electronically commutated permanent magnet type motors. Moreover, due to acoustical considerations, these motors are typically operated at considerably less than their optimum speed which further reduces their electrical efficiency. These motors also typically run at a higher temperature due to electrical inefficiencies. The consistent control of air circulator speed is also missing with permanent-split capacitor motors or three-phase induction motors.

The present invention is directed to overcoming one or more of the problems set forth above.

SUMMARY OF INVENTION

The present invention is directed to an air circulator. This air circulator includes an electronically commuted motor that is devoid of a transformer, the motor having a rotor, a rotatable blade assembly having at least one blade, where the blade assembly is connected to the rotor of the electronically commuted motor, a housing that is operatively connected to the electronically commuted motor and having an input for line voltage, and a switch that is secured to the housing and electrically connected to a signal voltage input of the electronically commuted motor and the line voltage input.

In another aspect of the invention, an air circulator is disclosed. This air circulator includes an electronically commuted motor that is devoid of a transformer, the motor having an electronic drive, a salient pole stator and a permanent magnet rotor with the electronic drive attached to the salient pole stator with the permanent magnet rotor rotatably positioned within the salient pole stator, a rotatable blade assembly having at least one blade, where the blade assembly is connected to the permanent magnet rotor of the electronically commuted motor, a housing that is operatively connected to the electronically commuted motor and having a line voltage input; and a switch that is secured to the housing and electrically connected to a signal voltage input of the electronically commuted motor and the line voltage input.

Still yet another aspect of the present invention is that a method for utilizing an air circulator is disclosed. The method includes utilizing an electronically commuted motor that is devoid of a transformer, the motor having a rotor with a rotatable blade assembly having at least one blade, where the blade assembly is connected to the rotor of the electronically commuted motor, and operating a switch that is secured to a housing and electrically connected to the electronically commuted motor and an input for line voltage, where the housing is operatively connected to the electronically commuted motor and includes an input for line voltage and the switch that is secured to the housing and electrically connected to a signal voltage input of the electronically commuted motor and the line voltage input.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

Figure 1:
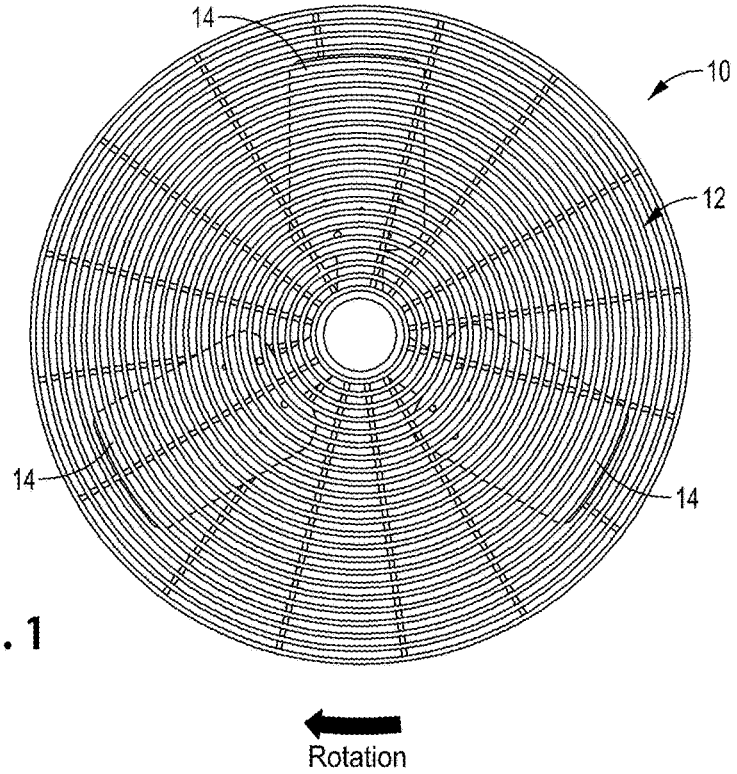
FIG. 1 is a front elevational view of the preferred embodiment of an air circulator in accordance with the invention.

Reference characters in the written specification indicate corresponding items shown throughout the drawing figures.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as to obscure the present invention.

Figure 2:
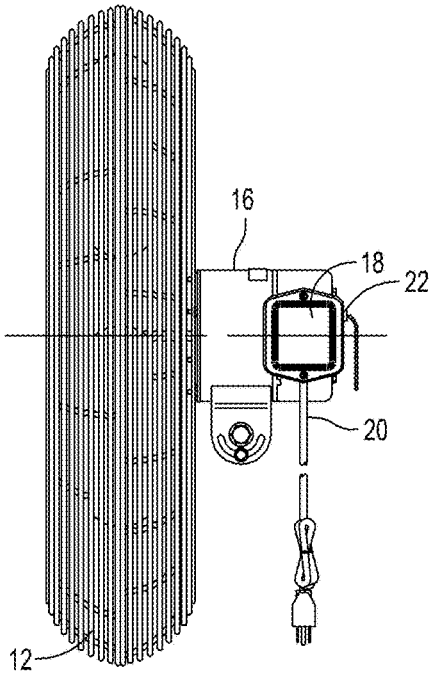
FIG. 2 is a side elevational view of the air circulator shown in FIG. 1 including a housing, an input for receiving line voltage and a switch 22.

The preferred embodiment of an air circulator is generally indicated by numeral 10 in FIG. 1. A blade guard for the air circulator 10 is generally indicated by numeral 12. This blade guard 12 performs the dual function of maximizing air flow while providing protection from the rotatable blade assembly 14. A wide variety of materials can be utilized for the blade guard 12 including, but not limited to, metal and plastic. The rotatable blade assembly 14 are rotatably connected to an electronically commuted motor (hereinafter "ECM") 16 as shown in FIG. 2. The ECM 16 is preferably, but not necessarily, connected to a housing 18 that includes an input for receiving line voltage 20 for the ECM 16 as well as providing a mounting structure for a switch 22. This line voltage is used for two purposes, first to power the ECM 16, and secondly to provide a signal voltage to the electronic drive 86 for the ECM 16, shown in FIGS. 7 and 8, to determine a pre-programmed speed at which the ECM 16 will operate the air circulator 10. Line voltage, is defined as either nominally 115 VAC or 230 VAC. This provides a marked contrast and advantage over standard ECM motors that operate with a 24 VAC signal voltage due to the fact that there is not a requirement for an additional step-down transformer to create the 24 VAC signal.

Figure 3:
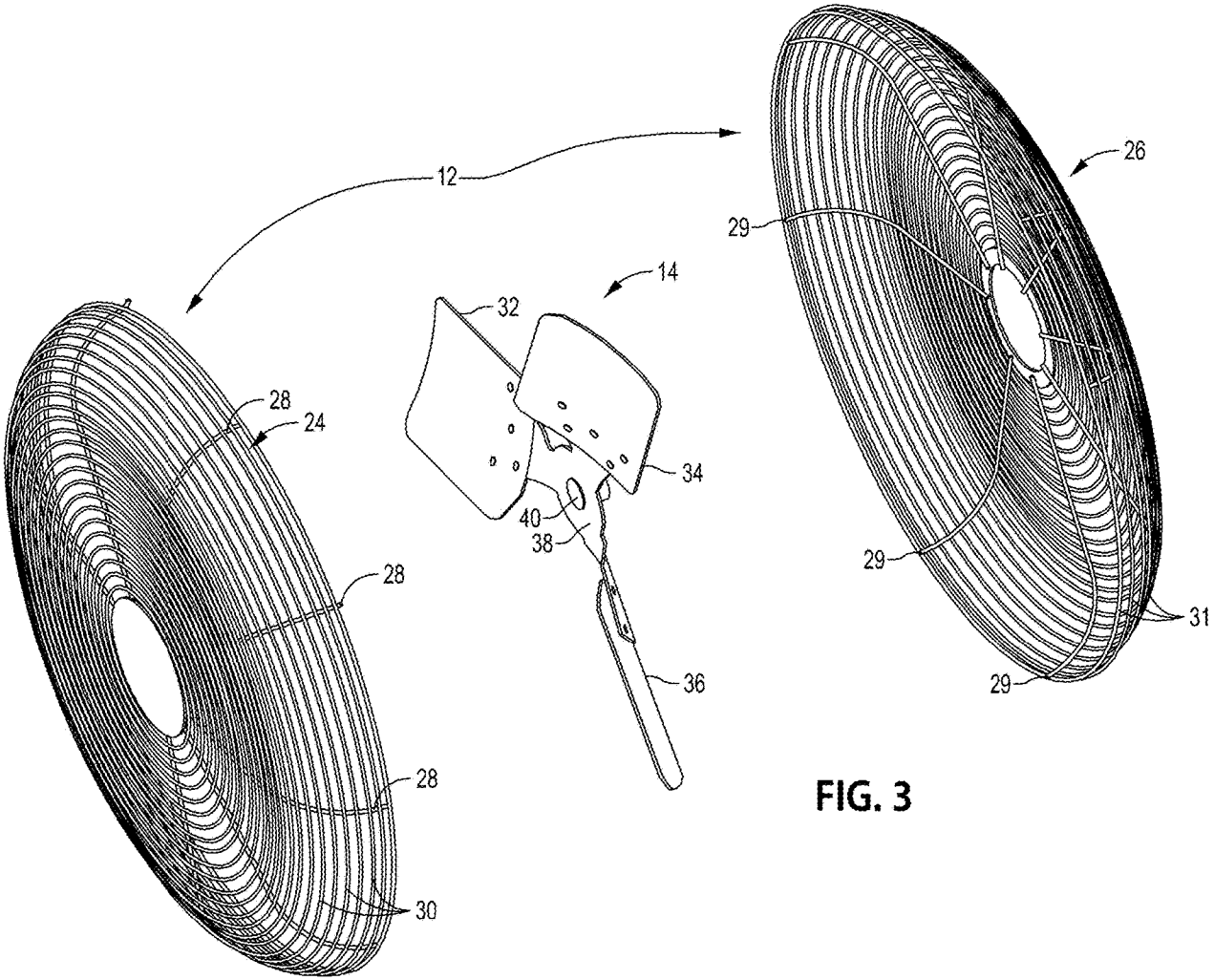
FIG. 3 is an exploded perspective view of a front blade guard portion, a rotatable blade assembly and a rear blade guard portion.

Referring now to FIG. 3, the blade guard 12 includes a front blade guard portion 24 and a back blade guard portion 26 that are connected together or from an integral unit. The front blade guard portion 24 includes a first series of radially extending support members 28 that extend outward from the center of the front blade guard portion 24 that are connected to a first series of concentric members 30 to form an integral structure. The back blade guard portion 26 includes a second series of radially extending support members 29 that extend outward from the center of the back blade guard portion 26 that are connected a second series of concentric members 31 to form an integral structure.

Figure 4:
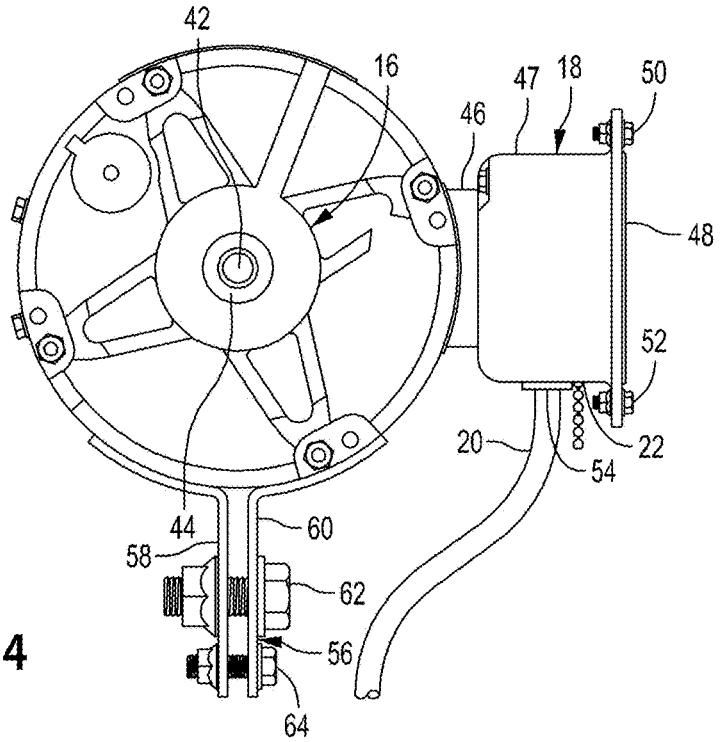
FIG. 4 is a front elevational view of an electronically commuted motor (ECM) connected to a housing through a securing member with an input for receiving line voltage and a switch, e.g., pull switch.

The previously referenced rotatable blade assembly 14 can vary in shape, size and number. A wide variety of materials can be utilized for the rotatable blade assembly 14 including, but not limited to, metal and plastic. In the illustrative, but nonlimiting, embodiment, the rotatable blade assembly 14 includes a first rotatable blade 32, a second rotatable blade 34 and a third rotatable blade 36. However, the number of rotatable blades can vary tremendously. The first rotatable blade 32, the second rotatable blade 34 and the third rotatable blade 36 are all connected together and preferably, but not necessarily, integrally attached to a support member 38. The center of the support member 38 preferably includes an aperture 40. The aperture 40 of the support member 38 slides over the rotor 42, and is preferably, but not necessarily, connected in position with a securing hardware, e.g., nut 44, as shown in FIG. 4. Throughout this patent application, when nuts and bolts are specified, any of a wide variety of attachment and connecting mechanisms may suffice including, but not limited to, mechanical hardware, adhesives, welding and brazing.

Figure 5:
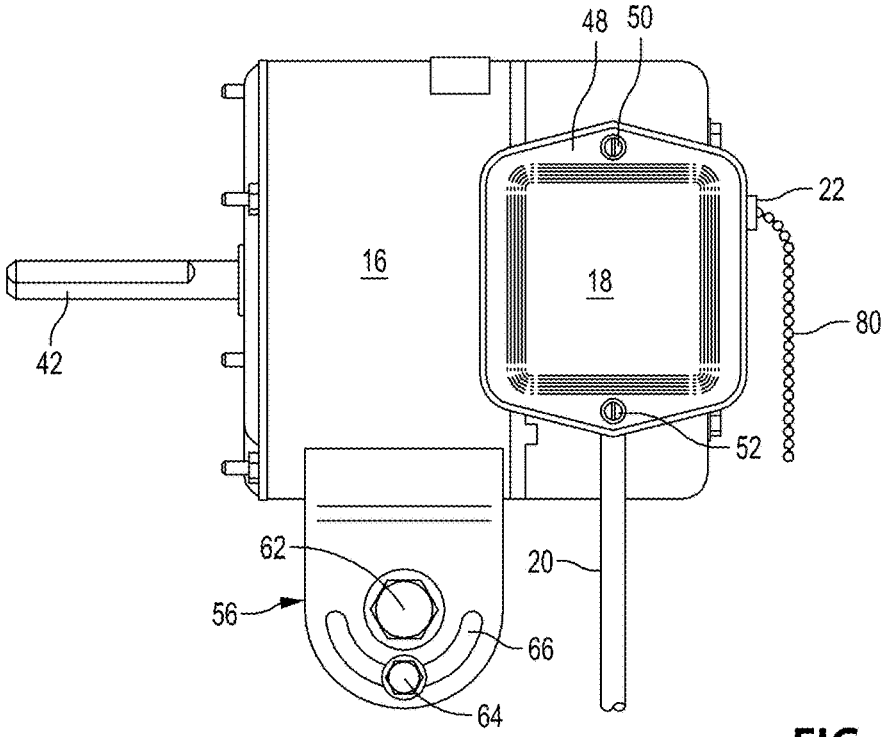
FIG. 5 is a side elevational view of an electronically commuted motor (ECM) connected to a housing through a securing member with an input for receiving line voltage and a switch, e.g., pull switch, as shown in FIG. 4.

A significant advantage to the present invention is that the ECM 16 is directly powered from an input for receiving line voltage 20, as shown in FIGS. 4 and 5, rather than utilizing a separate and costly electronic voltage control. The housing 18 includes an outer frame 47 that is connected to a plate 48 with preferably, but not necessarily, a first hardware connection, e.g., nut and bolt combination 50 and a second hardware connection, e.g., nut and bolt combination 52. There is a connector 54 for providing an opening and sealed connector for the inputted line voltage 20. An optional securing member 46 located between the housing 18 and the ECM 16 may be utilized is shown in FIG. 4.

Although a wide variety of connectors may be utilized for securing the ECM 16, an illustrative, but nonlimiting, example includes u-shaped bracket 56 which includes a first connecting member 58 and a second connector member 60 that are attached by a third hardware connection, e.g., nut and bolt combination 62. There is a fourth hardware connection, e.g., nut and bolt combination 64 that can be moved within a u-shaped aperture 66 and secured to any point within the u-shaped aperture 66, shown in FIG. 5.

Figure 6:
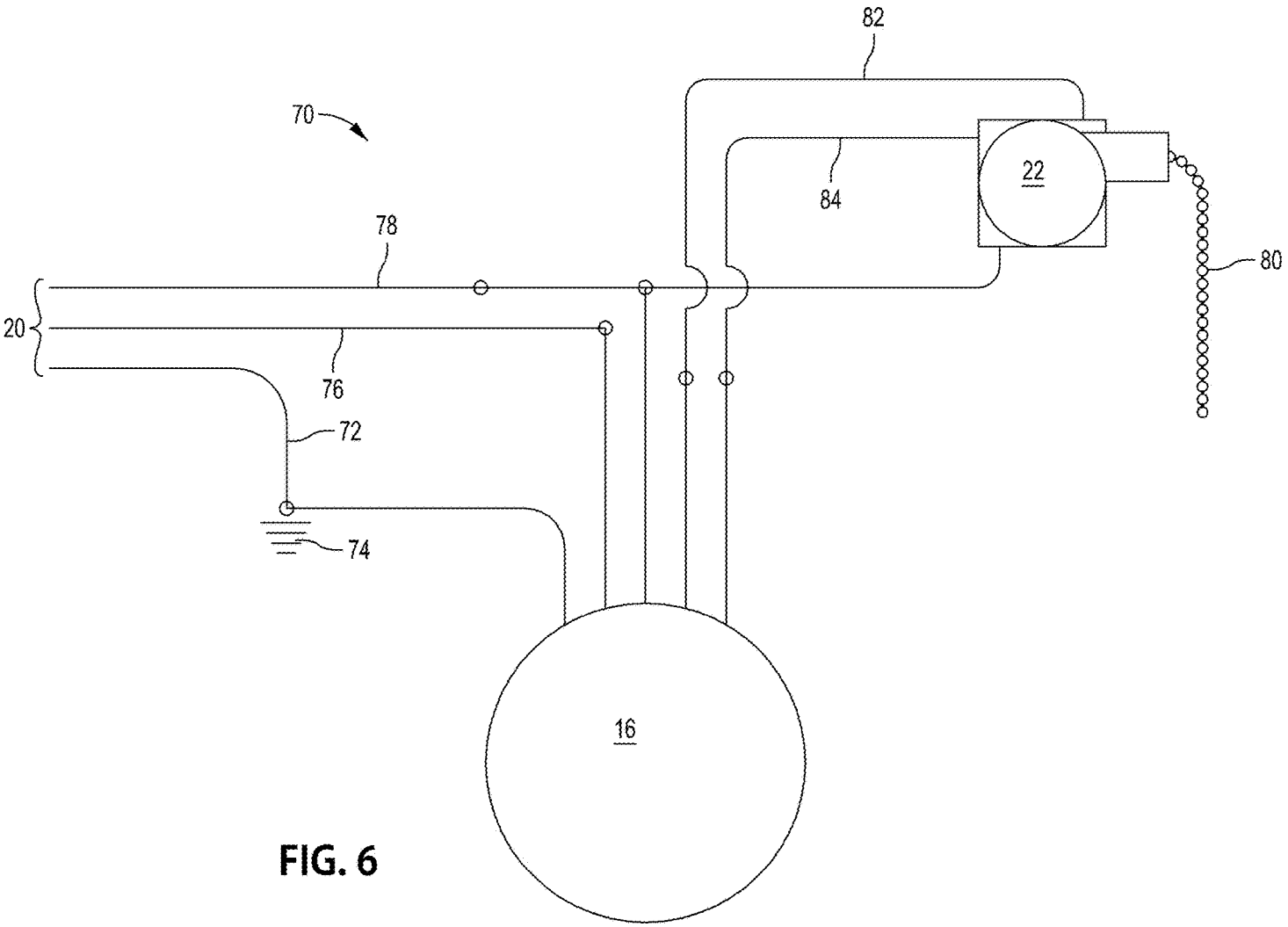
FIG. 6 is an electrical schematic of the line voltage input, the electronically commuted motor (ECM) and a switch, e.g., pull switch, shown in FIGS. 5 and 6.

Referring now to FIG. 6, an electrical schematic is generally indicated by numeral 70. The previously referenced input for line voltage 20 includes a first wire 72 that is connected to ground 74 and is directly connected to the ECM 16. There is a second wire 76 that is neutral that is electrically connected directly to the ECM 16. There is a third wire 78 that provides external line voltage that is electrically connected to the switch 22 for signal voltage and the ECM 16 for power to operate the ECM 16. An illustrative, but nonlimiting, switch 22, where the outer portion is also shown in FIGS. 2, 4 and 5, which may be utilized, is a pull switch that utilizes a chain 80. However, numerous other types of switches may suffice for switch 22. In this illustrative, but nonlimiting, embodiment there is a first output wire 82 that is electrically connected between the switch 22 and the ECM 16. There is also a second output wire 84 that is that is electrically connected between the switch 22 and the ECM 16. When signal voltage is applied to the first wire 82, the ECM 16 rotates at a high speed. Also, when signal voltage is applied to the second wire 84, the ECM 16 rotates at a middle speed. Moreover, when signal voltage is applied to both the first wire 82 and the second wire 84, the ECM 16 rotates at the lowest speed. The signal voltage is interpreted by the electronic drive 86 for the ECM 16, shown in FIGS. 7 and 8, to determine a pre-programmed speed at which the ECM 16 will operate.

Figure 7:
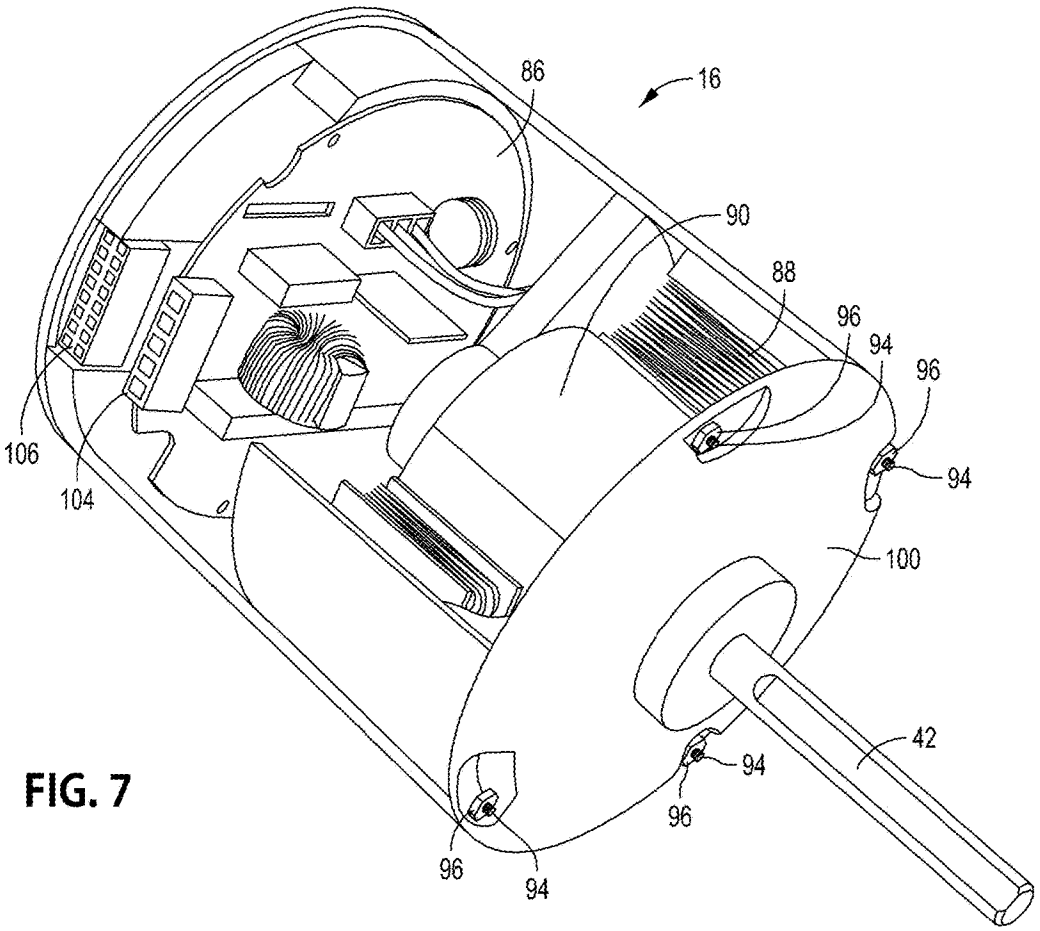
FIG. 7 is an exposed perspective view of the electronically commuted motor (ECM) shown in FIGS. 5 and 6.
Figure 8:
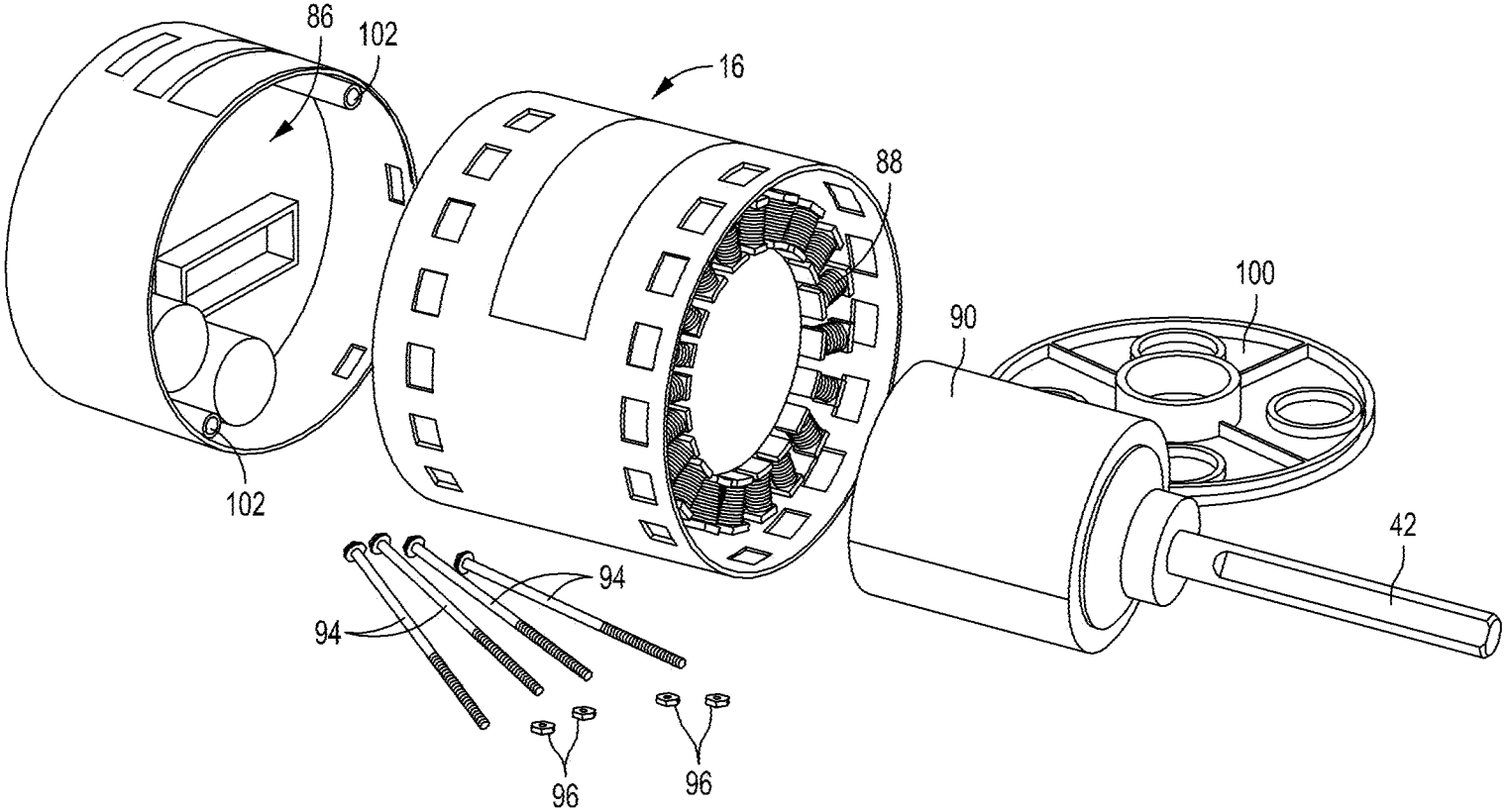
FIG. 8 is an exploded view of the components forming the electronically commuted motor (ECM) shown in FIG. 7

Referring now to an exposed view of FIG. 7 and in an exploded view in FIG. 8, the ECM 16 is shown which includes an electronic drive 86, a salient pole stator 88, and permanent magnets 90 that are connected to the rotor 42. The salient pole stator 88 is positioned on top of the electronic drive 86. The permanent magnets 90 are located within the salient pole stator 88 and rotatable therein. There is a cover plate 100 that is utilized to secure the rotor 42 within the salient pole stator 88 to the electronic drive 86 through hardware, e.g., bolt 94 and nut 96, combinations. The bolts 94 are secured in guide tubes 102 in the electronic drive 86, as shown in FIG. 8.

An illustrative, but nonlimiting, example of permanent magnets 90 includes ferrite magnets. Losses due to the permanent magnet rotor 42 are very low. The electronic drive 86 provides control of both speed and torque with high efficiency and low energy use. Speed ramping is also potentially available as well as diagnostics. Lower temperature swing between cycles is also present. There is an input voltage receptacle 104 for receiving line voltage into the electronic drive 86. It has circuitry that converts single phase power into three-phase power received from the input voltage receptacle 104. The three-phase power remains fully synchronized to the rotor 42, which has the permanent magnets 90 attached thereto.

An illustrative, but nonlimiting, example of an ECM motor for the present invention, includes an ECM 142™, which is manufactured by Regal Beloit Corporation, having a place of business at 200 State Street, Beloit, Wis. 53511-6254. This is a one-third horsepower motor with 115 volts, 60/50 Hertz, 5.8 Amperes with a counter-clockwise rotation. The circuitry of the electronic drive 86 receives voltage signals to indicate the desired speed. The rotation per minute is three values, i.e., 570, 768 and 972, for the low speed, middle speed and high speed referenced previously above, respectively. The signal voltage is designed to be the same voltage as the line voltage so no auxiliary transformers are required to treat the signal voltage. There is a signal voltage receptacle 106 in addition to the input voltage receptacle 104 that are electrically connected to the electronic drive 86, as shown in FIG. 7.

Furthermore, it should be understood that when introducing elements of the present invention in the claims or in the above description of the preferred embodiment of the invention, the terms "have," "having," "includes" and "including" and similar terms as used in the foregoing specification are used in the sense of "optional" or "may include" and not as "required." Similarly, the term "portion" should be construed as meaning some or all of the item or element that it qualifies.

Thus, there have been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims that follow.

The invention claimed is:

1. An air circulator comprising:

an electronically commuted motor, that is devoid of a transformer, the motor having a rotor;

a rotatable blade assembly having at least one blade, wherein the blade assembly is operatively connected to the rotor of the electronically commuted motor such that the blade assembly rotates with the rotor;

a housing that is operatively connected to the electronically commuted motor and having an input for line voltage; and a switch that is secured to the housing and electrically connected to a signal voltage input of the electronically commuted motor and the line voltage input.

2. The air circulator in accordance with claim 1, wherein the switch includes a pull switch that operates to turn the electronically commuted motor on and off.

3. The air circulator in accordance with claim 2, wherein the pull switch also operates to change speeds of the electronically commuted motor.

4. The air circulator in accordance with claim 2, wherein the pull switch includes a chain.

5. The air circulator in accordance with claim 1, further includes a securing member between the electronically commuted motor and the housing.

6. The air circulator in accordance with claim 1, wherein the rotatable blade assembly includes a plurality of blades attached to a support member.

7. The air circulator in accordance with claim 6, wherein the plurality of blades includes at least three blades.

8. The air circulator in accordance with claim 6, wherein the support member includes a central aperture that encircles the rotor of the electronically commuted motor.

9. The air circulator in accordance with claim 1, further including a blade guard having a plurality of apertures for air flow and surrounding the rotatable blade assembly.

10. The air circulator in accordance with claim 9, wherein the blade guard includes a front blade guard portion and a back blade guard portion that are integrally connected together.

11. The air circulator in accordance with claim 9, wherein the blade guard is circular.

12. The air circulator in accordance with claim 10, wherein the front blade guard portion includes a first plurality of radially extending support members that are connected transversely to a series of first concentric members to form a first integral structure and the rear blade guard portion includes a second plurality of radially extending support members that are connected transversely to a series of second concentric members to form a second integral structure, wherein the first integral structure and the second integral structure are connected together.

13. The air circulator in accordance with claim 1, wherein the electronically commuted motor includes an electronic drive, a salient pole stator and a permanent magnet rotor, wherein the electronic drive is attached to the salient pole stator with the permanent magnet rotor rotatably positioned within the salient pole stator.

14. The air circulator in accordance with claim 13, further including a cover plate to retain the permanent magnet rotor within the salient pole stator and is attached to the salient pole stator and the electronic drive.

15. The air circulator in accordance with claim 13, wherein the electronic drive is configured to operate the electronically commuted motor in at least two different speeds.

16. An air circulator comprising:

an electronically commuted motor, that is devoid of a transformer, the motor having an electronic drive, a salient pole stator and a permanent magnet rotor with the electronic drive attached to the salient pole stator with the permanent magnet rotor rotatably positioned within the salient pole stator;

a rotatable blade assembly having at least one blade, wherein the blade assembly is connected to the permanent magnet rotor of the electronically commuted motor;

a housing that is operatively connected to the electronically commuted motor and having a line voltage input; and a switch that is secured to the housing and electrically connected to a signal voltage input of the electronically commuted motor and the line voltage input.

17. The air circulator in accordance with claim 16, wherein the switch includes a pull switch that operates to turn the electronically commuted motor on and off.

18. The air circulator in accordance with claim 16, further includes a blade guard having a plurality of apertures for air flow and surrounding the rotatable blade assembly.

19. The air circulator in accordance with claim 16, wherein the rotatable blade assembly includes a plurality of blades connected and attached to a support member.

20. A method for utilizing an air circulator comprising:

utilizing an electronically commuted motor, that is devoid of a transformer, the motor having a rotor with a rotatable blade assembly having at least one blade, wherein the blade assembly is operatively connected to the rotor of the electronically commuted motor such that the blade assembly rotates with the rotor; and operating a switch secured to a housing and electrically connected to the electronically commuted motor and an input for line voltage, wherein the housing is operatively connected to the electronically commuted motor and includes an input for line voltage and the switch that is secured to the housing and electrically connected to a signal voltage input of the electronically commuted motor and the line voltage input.

* * * * *